United States Patent [19]

Keenan, Jr.

[11] 3,970,146

[45] July 20, 1976

[54] SONIC CLEANING OF WELLS

[75] Inventor: Bernard J. Keenan, Jr., West Chester, Pa.

[73] Assignee: Sun Oil Company of Pennsylvania, Philadelphia, Pa.

[22] Filed: Nov. 1, 1974

[21] Appl. No.: 519,961

Related U.S. Application Data

[63] Continuation-in-part of Ser. No. 421,906, Dec. 5, 1973, abandoned.

[30] Foreign Application Priority Data

Sept. 2, 1974 New Zealand ..... 175302

[52] U.S. Cl. ..... 166/249; 166/312

[51] Int. Cl.[2] ..... E21B 37/00

[58] Field of Search ..... 166/249, 311, 312; 340/8 R

[56] References Cited

UNITED STATES PATENTS

| | | | |
|---|---|---|---|
| 3,150,346 | 9/1964 | Polly et al. | 340/8 R |
| 3,180,418 | 4/1965 | MacLeod | 166/311 |
| 3,322,196 | 5/1967 | Bodine, Jr. | 166/249 |
| 3,680,636 | 8/1972 | Berry et al. | 166/59 |
| R23,381 | 6/1951 | Bodine, Jr. | 166/249 |

*Primary Examiner*—Stephen J. Novosad

*Attorney, Agent, or Firm*—J. Edward Hess; Donald R. Johnson; Gary V. Pack

[57] ABSTRACT

A secondary recovery and pipe cleaning operation for expended wells such as petroleum bearing wells containing hardened residual deposits and trapped liquids wherein a sonic generator is placed within the liquid in the reservoir being drilled or in a liquid level in the well pipe, and sonic energy generated thereby is transmitted through the liquid to create new fissures or break up tars and produce the formation or clean deposits from the well pipe. Liquid such as diesel oil can be added to the formation prior to sonic stimulation where insufficient liquid is present to carry the sonic energy throughout the formation or in the well pipe. Also, the sonic generator is movable within the formation and can be self-propelled.

1 Claim, 1 Drawing Figure

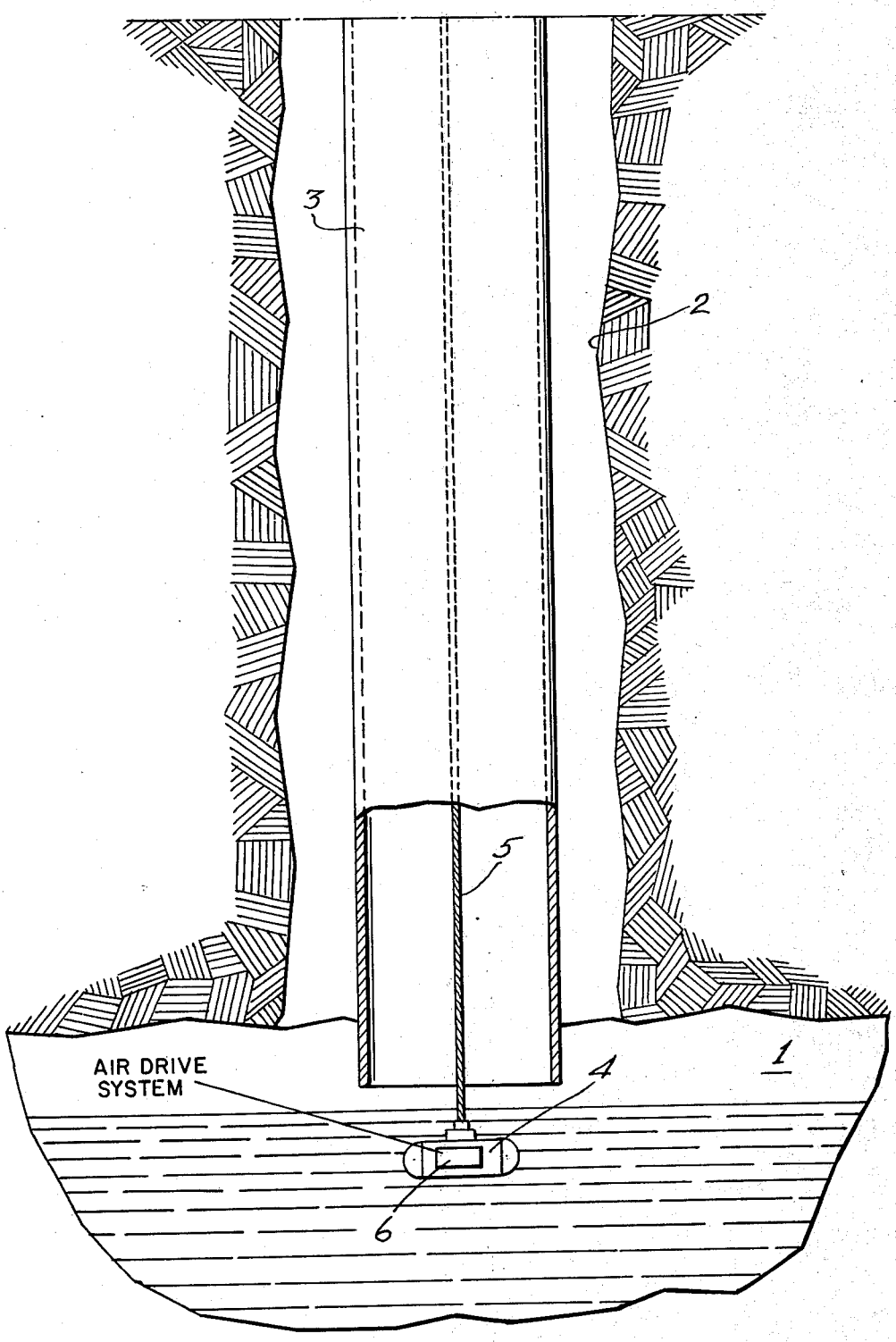
3
2
5
AIR DRIVE
SYSTEM
4
1
6

SONIC CLEANING OF WELLS

CROSS REFERENCE TO RELATED APPLICATIONS

This is a continuation-in-part of Ser. No. 421,906 filed Dec. 5, 1973, now abandoned.

BACKGROUND OF THE INVENTION

1. Field of the Invention

The present invention relates to a method for stimulating oil wells and the surrounding formations or cleaning the well pipe. More particularly, it relates to in situ sonic stimulation of underground formations penetrated by a well hole wherein unrecoverable liquids are trapped by residual tars or within untapped cavities which can be broken up or opened by sonic energy and cleaning the interior walls of the well pipe sections of deposits from production therethrough.

2. Description of the Prior Art

Acoustic energy has been used for drilling a liquid filled borehole by periodically reducing hydrostatic pressure in the borehole and simultaneously introducing acoustic energy to effect cavitation in the liquid. Also sonic vibration of an elastic stem for taking core samples is known. Drilling of boreholes by acoustic pulses in the range of cavitation is also known. However in all drilling techniques for recovering certain hydrocarbons or other fluids from subterranean formations, a point is often reached where the remaining recoverable fluids are trapped within the reservoir by residual tars or within untapped pockets within the formation.

Many secondary recovery operations for stimulating such wells are known in the prior art. Among these are acid treatment, burning, high pressure fracturing and the like. The skilled driller will choose a method among these to stimulate a given well depending upon the conditions he believes exist within the formation. The present invention adds another secondary recovery operation to his repertoire. Further, it provides a method of cleaning the well pipe of blocking deposits thereby increasing its flow area.

SUMMARY OF THE INVENTION

A method for stimulating expended wells and cleaning well pipe in situ is now put forth which comprises placing a sonic generator in the liquid layer within the underground formation being drilled and transmitting sonic energy through that liquid to the entire reservoir so as to break up hard tars and create new fissures and stimulate the production. Sonic energy as the term is used herein includes the audible as well as the ultrasonic frequency ranges. Further, the sonic generator can be placed in a standing lead of liquid in the well pipe to transmit sonic energy to it thereby loosening and removing deposited obstructions.

The sonic generator is self-propelled and powered, preferably, through an electrical cable from the surface. However, the unit can be battery operated for short duration stimulations. If sufficient liquid is not present within the formation, the void spaces can first be flooded with a suitable hydrocarbon liquid such as diesel oil and the sonic generator can be placed therein.

The sonic generator can be movable within the formation and up and down the length of the well pipe and can contain a system for propulsion through the liquid, such as an air drive, a motor and propeller, and the like.

A remotely operated guidance system can also be provided.

An air drive propulsion system includes an air or gas source usually pumped from the surface and an exit pipe on the generator with a control valve. By actuating the valve, varying amounts of air or other gas are thereby released and cause the generator location to be changed.

The propeller system with a rudder can be mounted on the generator and the speed of the propeller as well as the position of the rudder can be controlled from the surface electrically.

Many advantages can be gained by using such a secondary recovery and cleaning operation. Once the formation is flooded or contains a liquid body sufficient to support the sonic generator, the sound energy can be transmitted to the farthest reaches of the formation, as long as liquid has reached there, or up to any desired level in the well pipe.

With an in-hole movable generator, the energy to stimulate the formation can be concentrated in a chosen location. Also, the generator can be quickly and easily run down the drill pipe or well pipe into the formation and may achieve results without the expensive time and equipment often required by known secondary recovery techniques.

This system can be used in the recovery of petroleum liquids or other subterranean fluids such as water.

These and other advantages will be more apparent upon review of the description of the drawing and the preferred embodiment which follows.

DESCRIPTION OF THE DRAWING AND THE PREFERRED EMBODIMENT

The FIGURE illustrates a typical environment of a well hole in which the method of the invention can be practiced.

The drawing shows an underground reservoir 1, penetrated by a well hole 2 containing a drill pipe or drill string 3. A sonic generator 4 is placed in the liquid layer in the reservoir and is connected to the surface by a cable 5. This cable can be either an electrical supply source for the sonic generator or merely a way of lowering and removing the battery powered sonic generator and can contain a conduit to carry air or gas for propulsion as previously described.

In a reservoir without a sufficient liquid level, the first step of the stimulation process is to put a liquid such as diesel oil into the formation. The liquid fuel required is that level sufficient to submerge the sonic generator and to cover the sections of the formation which are to be stimulated since the liquid is the transmission medium for the sound waves. Next, the sonic generator is lowered into the liquid within the reservoir and sound waves produced set up a wave pattern in the liquid thereby breaking up tars in the formation and creating new fissures from which petroleum fluids can be removed. If the formation contains sufficient residual liquids to carry the sonic energy then none need be added. The sonic generator is a self-contained electrically actuated sound source and when placed within a liquid supply will generate a sound wave which is transmitted therethrough. Also, it can be located in a liquid level in the well pipe to accomplish cleaning thereof. If a sufficient liquid lead is not available, a liquid such as diesel oil can be added. Sound wave generators are commercially available and can be adapted to use in this environment by encapsulation in a suitable container so as to prolong the life of the mechanism. The sonic energy required to produce results in a given formation or well pipe such as short bursts or prolonged sonic transmission or varying frequencies or intensities can be determined by experimentation by a reasonably skilled practitioner. To further assist in changing the position of sonic generator 4 in well hole 2, an air drive system 6 can be incorporated within sonic generator 4. Air drive system 6 can include a control valve which regulates the magnitude and direction of the air released from sonic generator 4.

The invention claimed is:

1. A method of cleaning a well pipe penetrating a fluid bearing formation comprising:

a. adding diesel oil to the well pipe to maintain the liquid level at the desired level in the well pipe;

b. placing a sonic generator with an air drive self propulsion unit below the liquid level in said well pipe;

c. producing sound waves with the sonic generator in the liquid at sufficient intensity to break up residual tars and deposits inside the well pipe;

d. activating the self propulsion unit so that the sonic generator is propelled through the entire length of pipe to be cleaned; and e. removing said deposits by means of fluid flow through said well pipe from said fluid bearing formation.

* * * * *